United States Patent [19]

Milcamps et al.

[11] 4,055,770

[45] Oct. 25, 1977

[54] COLLIMATOR ARRANGEMENT FOR A BEAM OF ACCELERATED CHARGED PARTICLES

[75] Inventors: Jacques Milcamps; Alain Penet, both of Paris, France

[73] Assignee: C.G.R.-Mev., France

[21] Appl. No.: 500,742

[22] Filed: Aug. 26, 1974

Related U.S. Application Data

[63] Continuation of Ser. No. 339,857, March 9, 1973, abandoned.

[30] Foreign Application Priority Data

Mar. 15, 1972 France ..... 72.08926

[51] Int. Cl.[2] ..... G21F 5/04

[52] U.S. Cl. ..... 250/505; 250/511

[58] Field of Search ..... 250/505, 511, 512, 513

[56] References Cited

U.S. PATENT DOCUMENTS

| | | | |
|---|---|---|---|
| 2,542,196 | 2/1951 | Haupt | 250/511 |
| 2,959,680 | 11/1960 | Green | 250/513 |
| 3,227,880 | 1/1966 | Wideroe | 250/505 |

*Primary Examiner*—Craig E. Church

*Attorney, Agent, or Firm*—Cushman, Darby & Cushman

[57] ABSTRACT

A collimator arrangement, which, in association with a charged particle accelerator, makes it possible to produce a uniform irradiation beam throughout a predetermined zone, comprises: a first collimator system, provided with movable elements $M_1$, $M_2$, $M_3$, $M_4$ and $m_1$, $m_2$, $m_3$, $m_4$, and a second collimator system associated to the first collimator system and comprising sets of metal strips $L_1$, $L_2$, $L_3$, $L_4$ and $l_1$, $l_2$, $l_3$, $l_4$ fixed at four supporting-rods integral with the first collimator system.

4 Claims, 2 Drawing Figures

COLLIMATOR ARRANGEMENT FOR A BEAM OF ACCELERATED CHARGED PARTICLES

Figure 1:
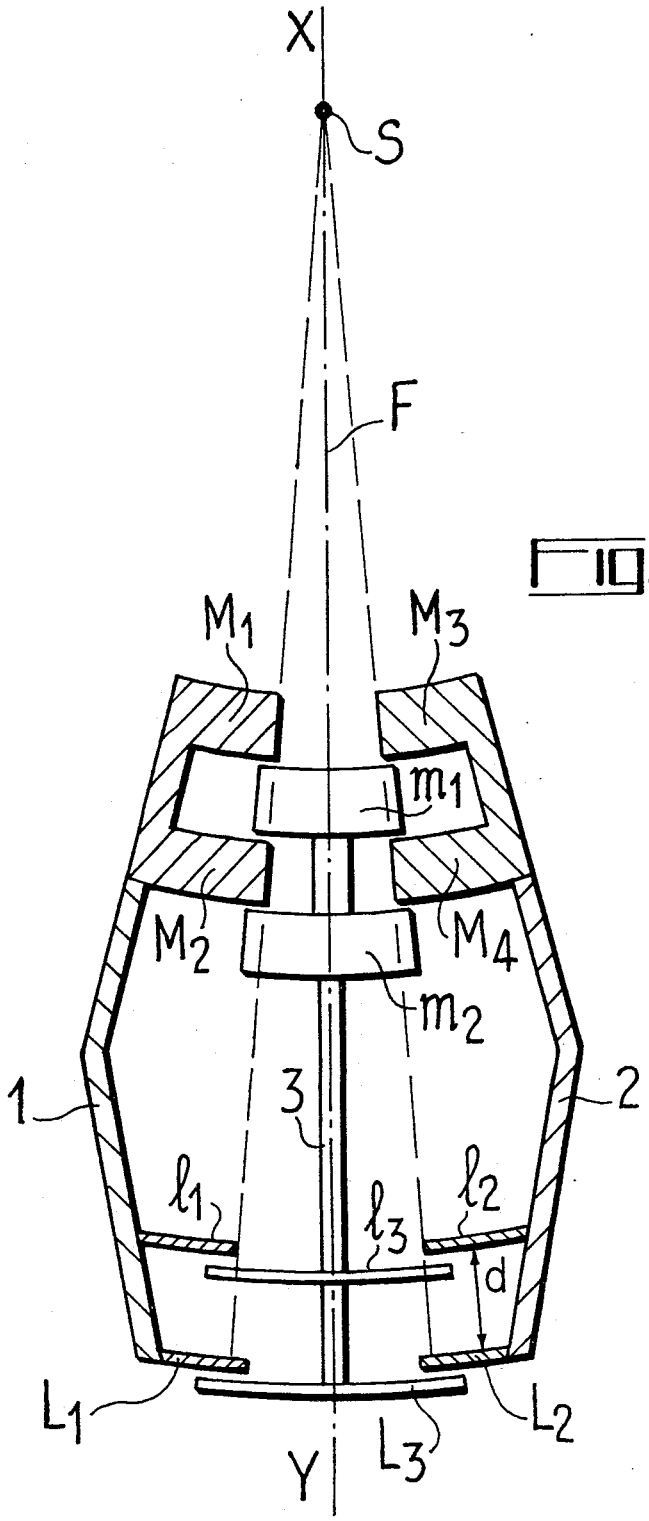

This is a continuation of application Ser. No. 339,857 filed Mar. 9, 1973 now abandoned.

In the majority of medical applications using an accelerated charged particle beam, it is necessary to delimit exactly the area which is to be exposed to the effect of such a beam. Moreover, the irradiating flux obtained with this charged particle beam must be as uniform as possible.

Conventionally, the accelerated charged particle beam issued from the evacuated enclosure of the accelerator, passes through a collimating system before striking the zone being irradiated. The diffusion of these particles, due to their collision with the internal surfaces of the collimator, reduces the radiation dose at the edges of the irradiated zone. These "edge effects," which depend upon the particle energies, are generally compensated or eliminated by reflective or absorbent walls associated with the collimator. The particle striking these walls (which may be the lateral walls of a frustum of a cone or a frustum of a pyramid), are partially absorbed or partially diffused through a solid angle which depends both upon the nature of the material of the walls and upon the incidence angle of the beam on said walls.

However, these absorbent walls have well-defined dimensions and it is therefore necessary to replace them if it is desired to irradiate areas having different sizes. This involves delicate and elaborate operations. Moreover, the diffused particles experience a certain energy loss and their penetration into the irradiated surface will be less deep than that of undiffused particles.

It is an object of the invention to overcome these drawbacks.

According to the invention, there is provided a collimator arrangement, for an accelerated charged particle beam, comprising a first collimator system for partially intercepting said charged particle beam and a second collimator system associated with said first collimator system for intercepting the diffused particles of said beam and the secondary particles produced by said beam impinging upon said first collimator system, said collimator arrangement having an axis XY which is coincidental with the mean path of said beam; said first collimator system comprising two pairs of movable supports, said movable supports respectively carrying a pair of collimating elements thereof, said collimating elements of a pair of movable supports facing to each other, said movable supports of each pair being mechanically associated to one another and symmetrically disposed with respect to a plane containing said axis XY, and said second collimator system comprising two pairs of support-rods mechanically associated with said movable supports, each of said support-rods carrying at least an intermediate metal strip and a terminal metal strip fixed at the free end of said support-rod, the internal edge of each intermediate strip being set back in relation to the internal edge of the terminal strip carried by the same support-rod, said intermediate strips and terminal strips of each pair of support-rods being respectively located opposite one another and symmetrically disposed with respect to a plane containing said axis XY.

Figure 2:
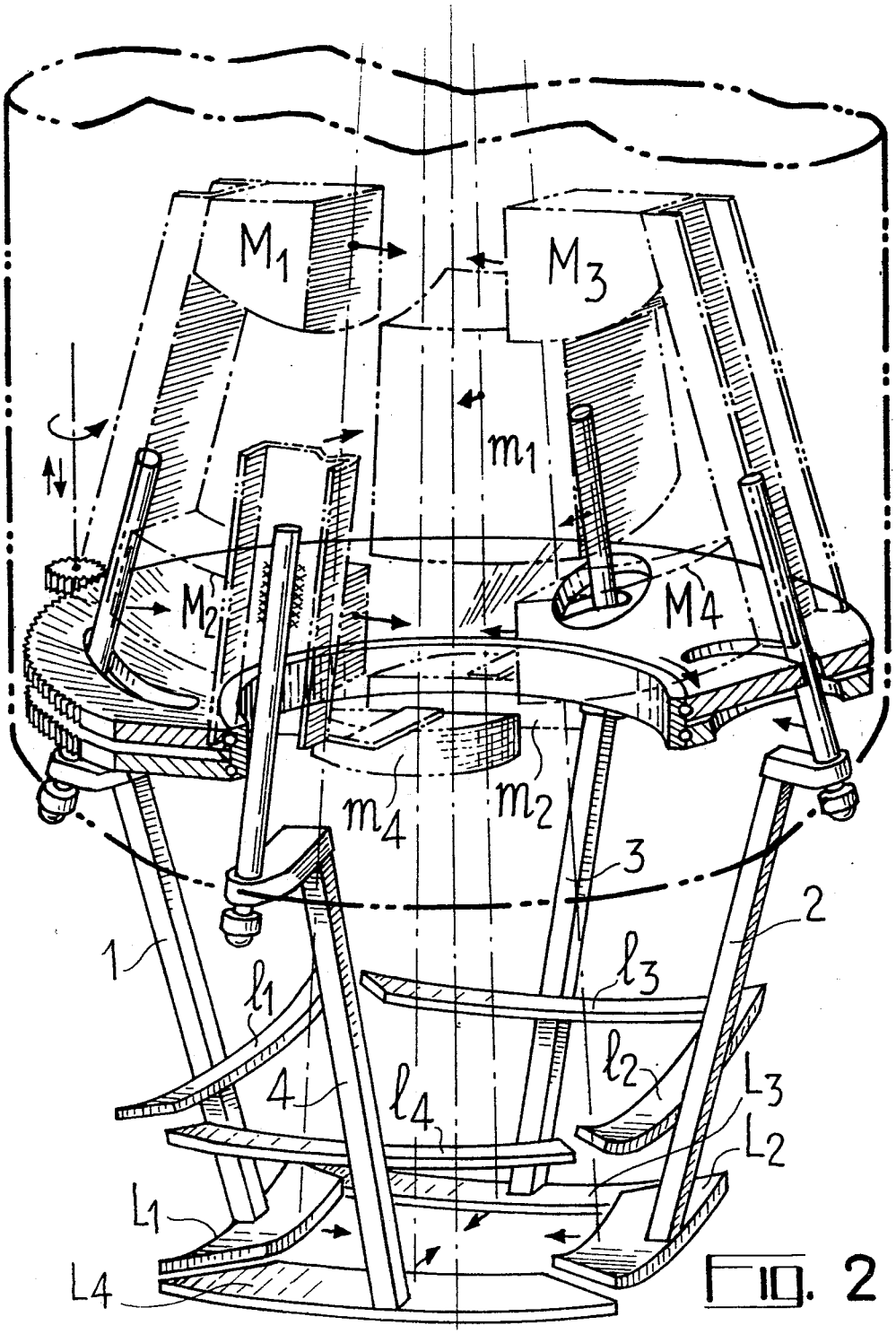

For a better understanding of the invention and to show how the same may be carried into effect, reference will be made to the drawings, given solely by way of example, which accompagny the following description, and wherein:

FIG. 1 shows schematically and in section, an arrangement according to the invention, and, FIG. 2 illustrates an assembled arrangement of the invention.

As shown in FIGS. 1 and 2, a first collimating system comprises, two pairs of jaws disposed at 90° to each other and respectively comprising the elements $M_1$, $M_2$, $M_3$, $M_4$ and $m_1$, $m_2$, $m_3$, $m_4$. The elements $M_1$ and $M_3$ on the one hand and the elements $M_2$ and $M_4$ on the other are identical and symmetrically disposed in relation to a plane containing the XY axis of the arrangement; the elements $m_1$ and $m_3$ on the one hand and the elements $m_2$ and $m_4$ on the other, are identical and symmetrically disposed in relation to an another plane containing the XY axis, the plane of symmetry of the elements $m_1$, $m_3$ and $m_2$, $m_4$ being located at 90° to the plane of symmetry of the elements $M_1$, $M_3$ and $M_2$, $M_4$ (In fact, the jaws $m_3$ and $m_4$ do not appear in FIG. 1 and the jaw $M_3$ does not appear in FIG. 2). The two pairs of jaws $M_1$, $M_3$ and $M_2$, $M_4$ can respectively be displaced by means of a system of cams, along a circular arc the center of curvature of which is substantially coincidental with the source S of the particle beam F. A second collimating system is constituted by four support rods 1, 2, 3, 4, integral with the first collimator system (the rod 4 located at the front of the FIG. 1 has not been shown), each of these rods respectively being equipped with strips $l_1$, $L_1$; $l_2$, $L_2$; $l_3$, $L_3$; $l_4$, $L_4$ which bound the surface being irradiated. The strips $L_1$, $L_2$, $L_3$, $L_4$ called terminal strips are respectively fixed, at their centres, to the free ends of the support rods 1, 2, 3, 4 whilst strips $l_1$, $l_2$, $l_3$, $l_4$ called intermediate strips are arranged at a distance $d$ from these terminal strips $L_1$, $L_2$, $L_3$, $L_4$, said distance $d$ depending upon the nature and energies of the charged particles. In the example chosen, the particles used are electrons.

The dimensions of the terminal and intermediate strips and the positions of the intermediate strips $l_1$, $l_2$, $l_3$, $l_4$ in relation to the terminal strips $L_1$, $L_2$, $L_3$, $L_4$ are determined so that the electrons diffused by the "edge effects" are eliminated thus ensuring uniform distribution of the radiation dose over the surface being irradiated, in the case of electrons of predetermined energy.

The intermediate strips $l_1$, $l_2$, $l_3$ and $l_4$ intercept a substantial part of the diffused electrons coming from the first collimator and thus make it possible to reduce very considerably the thickness of the terminal strips $L_1$, $L_2$, $L_3$ and $L_4$, this thickness depending upon the density of the material utilised and the maximum energy of the primary electrons. On the one hand, the thickness of the terminal strips $L_1$, $L_2$, $L_3$ and $L_4$ should be sufficient to attenuate the primary radiation beyond the desired section by a factor of at least 100, and on the other should be sufficiently thin to reduce to a maximum extent the width of the terminal strip sections which may cause the diffusion of electrons. In a preferred embodiment, the terminal strips $L_1$, $L_2$, $L_3$ and $L_4$ are made of three bonded laminae, one of lead 7mm thick, one of steel 4 mm thick and the last of aluminum 1.5 mm thick, giving them good mechanical strength. The indicated thicknesses here have been chosen for a device utilizing an electron beam having a maximum energy of 22 Mev. The terminal strips $L_1$, $L_2$, $L_3$ and have a length of around 30 cm and a width of around 5 cm. The intermediate strips $l_1$, $l_2$, $l_3$, $l_4$ are set back in relation to the terminal strips $L_1$, $L_2$, $L_3$ and $L_4$ in order to prevent secondary electrons issuing from the moving elements of the jaws, from reaching the zone being irradiated. These different strips have the shape of a portion of sphere and means are provided for displacing pairs of strips on superimposed spherical surfaces having same centre of curvature. The intermediate strips $l_1$, $l_2$, $l_3$, $l_4$ in the same way as terminal strips $L_1L_2$, $L_3$, $L_4$ are associated in pairs: each pair moves over a sphere of predetermined diameter. The second collimator system makes it possible to limit accurately the irradiation zone to the predetermined dimensions, the radiation dose being uniform throughout this zone. A collimator device of this kind is particularly advantageous when used in conjunction with a medical irradiation equipment which requires accurate and rapid adjustment of the dimensions of the irradiated zone.

The embodiment set out hereinbefore is in no way limitative and it is possible in particular to arrange several assemblies of intermediate strips before the terminal strip $L_1$, $L_2$, $L_3$, $L_4$.

What we claim is:

1. A collimator arrangement, for an accelerated charged particle beam, comprising a first collimator system for partially intercepting said charged particle beam and a second collimator system associated with said first collimator system for intercepting the diffused particles of said beam and the secondary particles produced by said beam impinging upon said first collimator system, said collimator arrangement having an axi XY which is coincidental with the mean path of said beam; said first collimator system comprising four pairs of collimating elements each formed as a jaw, four movable supports, each of said movable supports respectively carrying a pair of said collimating elements thereof separated from each other along the axis XY, each said jaw facing another jaw, said movable supports being mechanically connected to one another and symmetrically disposed with respect to a plane containing said axis XY for movement of said facing jaws toward and away from each other, and said second collimator system comprising four support-rods each mechanically associated with one of said movable supports for movement therewith, each of said support-rods carrying at least an intermediate metal strip and a terminal metal strip fixed at the free end of said support-rod, the internal edge of each intermediate strip being set back in relation to the internal edge of the terminal strip carried by the same support-rod, said intermediate strips and terminal strips of each pair of support-rods being thinner in the XY axis direction than said jaws and respectively located opposite one another and symmetrically disposed with respect to a plane containing said axis XY.

2. A collimator arrangement as claimed in claim 1, wherein said pairs of strips have the shape of a portion of sphere, said collimator arrangement comprising means for displacing each pair of strips on superimposed spherical surfaces having the same center of curvature.

3. A collimator arrangement as claimed in claim 1, wherein said intermediate strips are made of steel.

4. A collimator arrangement as claimed in claim 1, wherein said terminal strips are laminated and comprise three superimposed laminae and bonded together, one of lead, and two others of steel and aluminum respectively.

* * * * *